US009121239B2

(12) United States Patent
Schulte et al.

(10) Patent No.: US 9,121,239 B2
(45) Date of Patent: Sep. 1, 2015

(54) DEVICE FOR ANCHORING IN A CASING IN A BOREHOLE IN THE GROUND

(71) Applicants: Well Engineering Partners (WEP) B.V., Hoogeveen (NL); GOT German Oil Tools GmbH, Vechta (DE)

(72) Inventors: Christian Schulte, Vechta (DE); Konrad Johannes Bührmann, Vechta (DE); Thomas Walburgis Bakker, Hoogeveen (NL); Gerardus Godefridus Johannes van Og, Hoogeveen (NL)

( * ) Notice: Subject to any disclaimer, the term of this patent is extended or adjusted under 35 U.S.C. 154(b) by 0 days.

(21) Appl. No.: 14/318,144

(22) Filed: Jun. 27, 2014

(65) Prior Publication Data

US 2014/0305631 A1 Oct. 16, 2014

Related U.S. Application Data

(63) Continuation of application No. PCT/NL2012/050936, filed on Dec. 31, 2012.

(30) Foreign Application Priority Data

Dec. 30, 2011 (NL) ..... 2008061

(51) Int. Cl.

| | |
|---|---|
| ***E21B 23/00*** | (2006.01) |
| ***E21B 23/01*** | (2006.01) |
| ***E21B 7/20*** | (2006.01) |

(52) U.S. Cl.

CPC . *E21B 23/00* (2013.01); *E21B 7/20* (2013.01); *E21B 23/01* (2013.01)

(58) Field of Classification Search

CPC ..... E21B 23/01; E21B 17/1014; E21B 4/18; E21B 23/00; E21B 7/20; E21B 10/32; E21B 7/068; E21B 7/203

USPC ..... 175/97, 98, 103, 230, 288; 166/210, 166/216, 117.7, 243, 207

See application file for complete search history.

(56) References Cited

U.S. PATENT DOCUMENTS 1,112,946 A * 10/1914 Turnbull ..... 175/288
2,609,182 A * 9/1952 Arutunoff ..... 175/49

(Continued)

FOREIGN PATENT DOCUMENTS

| | | |
|---|---|---|
| EP | 1 581 718 | 10/2005 |
| WO | WO-93/17215 | 9/1993 |
| WO | WO-2004/070159 | 8/2004 |

OTHER PUBLICATIONS

International Search Report and Written Opinion for Application No. PCT/NL2012/050936, mail date Mar. 18, 2013, 11 pages.

*Primary Examiner* — Daniel P Stephenson

(74) *Attorney, Agent, or Firm* — Foley & Lardner LLP

(57) ABSTRACT

A device for anchoring in a casing in a borehole in the ground. The device comprises a shaft oriented in an axial direction, the shaft having a torque transfer section. The torque transfer section has axially oriented outer cam surfaces extending radially outwardly in a rotational sense. The shaft further has a plurality of clamping bodies circumferentially distributed around the torque transfer section with a limited movability relative to the torque transfer section in rotational sense and in radial directions. The clamping bodies each have an inner, axially oriented clamping body surface facing one of the cam surfaces of the torque transfer section and an outer surface defining a segment of a cylinder coaxial with said shaft.

14 Claims, 5 Drawing Sheets

(56) References Cited

U.S. PATENT DOCUMENTS

| | | | | | |
|---|---|---|---|---|---|
| 3,128,826 | A | | 4/1964 | Brown | |
| 4,051,910 | A | * | 10/1977 | Clark | 175/103 |
| 4,499,799 | A | | 2/1985 | Bordages | |
| 4,811,785 | A | * | 3/1989 | Weber | 166/117.7 |
| 5,771,970 | A | | 6/1998 | Jani | |
| 6,062,309 | A | * | 5/2000 | Gosse | 166/216 |
| 6,155,346 | A | * | 12/2000 | Aldridge | 166/216 |
| 6,227,313 | B1 | * | 5/2001 | Davis et al. | 175/89 |
| 7,121,350 | B2 | * | 10/2006 | Aldridge et al. | 166/382 |
| 7,287,584 | B2 | * | 10/2007 | Angman et al. | 166/177.4 |
| 8,191,652 | B2 | * | 6/2012 | Kotsonis et al. | 175/61 |
| 8,807,243 | B2 | * | 8/2014 | Surjaatmadja et al. | 175/57 |
| 2013/0299169 | A1 | * | 11/2013 | Rex et al. | 166/285 |

* cited by examiner

DEVICE FOR ANCHORING IN A CASING IN A BOREHOLE IN THE GROUND

CROSS-REFERENCE TO RELATED PATENT APPLICATIONS

The present application is a continuation of International Patent Application No. PCT/NL2012/050936 filed on Dec. 31, 2012 which claims priority to Netherlands Application No. NL2008061 filed on Dec. 30, 2011—the full disclosures of both are hereby incorporated herein by reference in their entireties.

BACKGROUND

The invention relates to a device for anchoring in a casing in a borehole in the ground. Such a device may for instance for downhole anchoring relative to a casing or lining of a rotary bottomhole assembly (BHA) for drilling and/or reaming a borehole in the ground, or for anchoring a drive for holding and rotating a casing.

After drilling a hole in the ground, for instance for use as an oil or gas well, for collecting geothermal energy, for storage of thermal energy or for installing a subterranean duct under a canal or other structure, usually a casing is ran into the well bore to act as a wall of the well. Casing strings are typically run into the well bore from the surface and hung from the surface or from an intermediate point between the ground surface and the bottom of the hole (in the form of a liner), each next casing string being passed down via a previously installed casing string. For sealing and holding the casing in place, cement may then be introduced in the annular space between the external surface of the casing and the internal surface of the well bore.

As the casing is run into a newly drilled section of the borehole, obstructions, such as ledges which form in the well bore material during drilling, formation washouts, or debris formed by unstable sections of the well bore wall collapsing, are often encountered. To allow the casing to pass such obstructions, a reamer shoe is conventionally mounted on a lower end of the casing string. The reamer shoe removes irregularities or obstructions from the wall of the bore and thereby facilitates the passage of the casing string and aids cementing.

It is also known to provide the lower end of the casing with an assembly including a motor and a drilling bit and an under reamer coupled to the motor, for drilling the hole as the casing is fed into the ground. The drilling bit drills a hole and is followed by the underreamer that enlarges the hole to a size beyond the bit diameter for allowing the casing and, if applicable, the reamer shoe mounted to the lower end of the casing, to follow the drilling bit and the underreamer. It is also possible to use a drillable or expandable drilling bit. During such operations, the casing is usually rotated driven by a top drive at the ground surface.

The underreamer or expandable drilling bit has cutting or crushing arms, which extend to a contour of a diameter larger than the diameter of the casing, the diameter of the borehole obtained thus typically being sufficient to allow the casing, or the reaming shoe at the lower end of the casing, to follow the underreamer or expandable bit. The blades can be retracted to a diameter smaller than the inner diameter of the casing to allow retraction of the reaming or drilling tool through the installed casing (or at least through the portion of the casing string installed following the drilling or reaming tool).

For such operations, tools are anchored relative to the casing or lining, for instance to hold a drilling tool against a torque resulting from rotation of a drill bit and/or a reamer applied to ground formations being drilled and/or reamed. European patent application 1 581 718 discloses an anchoring device for anchoring a well bore tool by latching and clamping an anchor carriage in a recess in an inner wall of a nipple connected into an end of the casing string. In an embodiment, oppositely tapered flanks of the anchor carriage and a mandrel generate the clamping force. However, in such a device axial loads exerted on the latched anchor carriage cause the anchor carriage to expand, which interferes with a required retraction if it is desired to release the anchor carriage from the recess, if the anchoring is to be released and special features are applied to counteract drag as the anchor carriage is moved through the casing.

SUMMARY

It is an object of the present invention to provide an anchoring device for anchoring in a casing or lining that can be released more easily and reliably.

According to the invention, this object is achieved by providing a casing system for lining a borehole in the ground comprising a casing section and a device for axially and rotationally anchoring in a casing in a borehole in the ground, the casing having an inner wall surface, where in the device comprises a shaft oriented in an axial direction, the shaft having a torque transfer section; the torque transfer section having axially oriented outer cam surfaces extending radially outwardly in a rotational sense, the shaft further comprising a drilling assembly including a drill bit and a reamer projecting from an end of the casing and wherein the lower end of the casing is located closely adjacent the reamer while the anchoring device is anchored to the casing; and a plurality of clamping bodies circumferentially distributed around the torque transfer section with a limited movability relative to the torque transfer section in rotational sense and in radial directions, the clamping bodies each having an inner, axially oriented clamping body surface facing one of the cam surfaces of the torque transfer section and an outer surface defining a segment of a cylinder coaxial with the shaft, wherein the clamping bodies are arranged for clamping against the inner wall surface and being released therefrom. The invention can also be embodied in a casing system for lining a borehole in the ground comprising a casing section and a device for anchoring in a casing in a borehole in the ground, the casing having an inner wall surface, in which the device comprises a shaft oriented in an axial direction, the shaft having a torque transfer section; the torque transfer section having axially oriented outer cam surfaces extending radially outwardly in a rotational sense, the shaft further comprising a drilling assembly including a drill bit and a reamer projecting from an end of the casing and wherein the lower end of the casing is located closely adjacent the reamer while the anchoring device is anchored to the casing; and a plurality of clamping bodies circumferentially distributed around the torque transfer section with a limited movability relative to the torque transfer section in rotational sense and in radial directions, the clamping bodies each having an inner, axially oriented clamping body surface facing one of the cam surfaces of the torque transfer section and an outer surface defining a segment of a cylinder coaxial with the shaft, wherein the clamping bodies are arranged for clamping against the inner wall surface and being released therefrom; wherein the inner wall surface of the casing section comprises at least one annular recess and wherein the anchoring device further comprising at least one latch for insertion into the at least one annular recess of the inner wall surface of the casing.

In response to a torque transferred from the casing to the anchoring device in the rotational sense or from the anchoring device to the casing in the opposite sense, the co-operating outer cam surfaces of the torque transfer section of the shaft and inner clamping body surfaces of the clamping bodies cause the clamping bodies to be clamped against the inner wall surface of the casing so that a clamped fixation of the anchoring device relative to the casing against displacement relative to the casing during rotation of the casing and/or a tool anchored to the casing is achieved. Because the co-operating outer cam surfaces of the torque transfer section of the shaft and inner clamping body surfaces of the clamping bodies are oriented axially, the clamping action and release or retraction of the clamping bodies is not significantly influenced by axial loads transfer between the casing and the anchoring device.

Further features, effects and details of the invention appear from the detailed description and the drawings.

DETAILED DESCRIPTION

Figure 1:
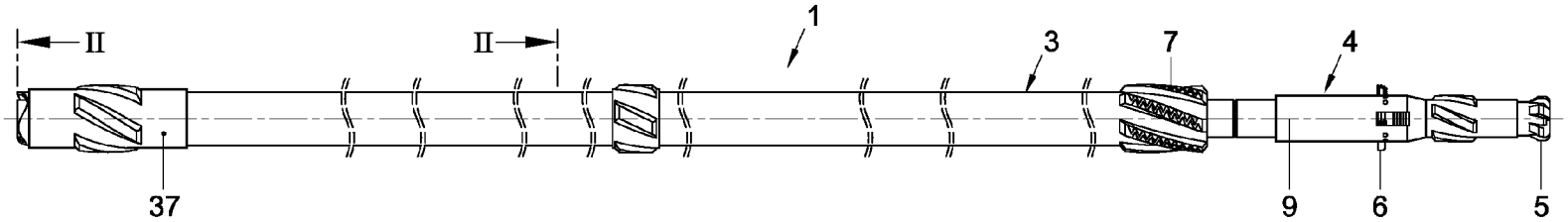
FIG. 1 is a side view of a distal end portion of an example of a casing system according to the invention carrying a bottomhole assembly (BHA) for drilling and/or reaming a borehole in the ground.

In the drawings, an example of a casing system 1 including an example of an anchoring device 2 according to the invention is shown. In the FIGS. 1-3 the distal end of the shown structures faces to the right. In most applications, the distal end will also form the bottom end, but the anchoring device and casing system according to the invention are also suitable for use in boreholes that are entirely or partially horizontal or even rising upward towards the distal end.

In the present example, the anchoring device 2 is anchored near a distal (usually bottom) end portion 3 of a casing. It is however also possible to anchor the device 2 near a proximal end of a casing, for instance for holding a casing or a liner relative to a top drive tool.

In FIG. 1, a tool in the form of a material removing assembly 4 is connected to the anchoring device 2. The material removing assembly 4 is a drilling and reaming unit having a material removing head constituted by a drilling bit 5 and a retractable underreamer 6 for removing ground material by drilling a borehole and reaming the drilled borehole to a larger diameter sufficient for allowing a casing shoe 7 at a lower end of the casing string to follow the material removing assembly 4 as it progresses into the ground.

With the anchoring device anchored to the casing, the lower end of the casing is located closely adjacent (preferably closer than a distance equal to the inner casing diameter) to the reamer, so that drilling direction of the material removing assembly can be controlled accurately and the material removing assembly is well protected against damage that may for instance be caused by hard and sharp formation encountered in a borehole in the ground.

Figure 2:
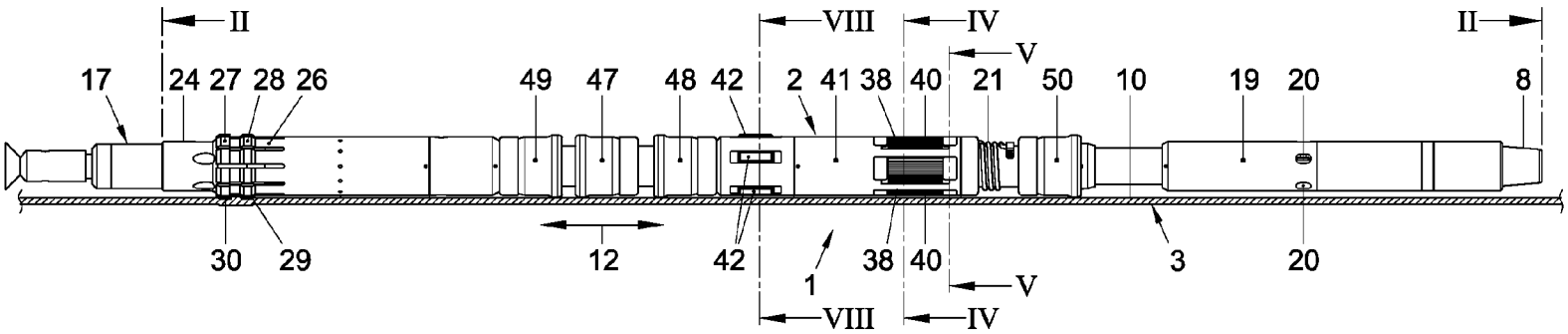
FIG. 2 is cut-away view of a portion of the casing system of FIG. 1 and of an example of an anchoring device according to the invention arranged therein.
Figure 3:
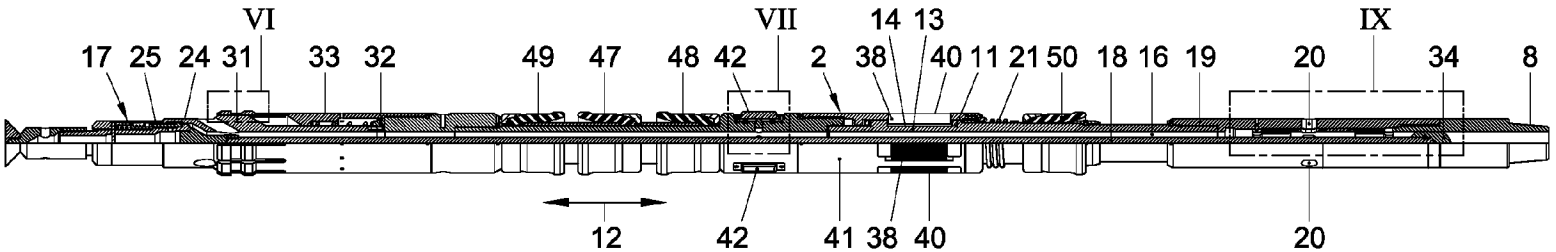
FIG. 3 is a cut-away view of the anchoring device shown in FIG. 2.
Figure 4:
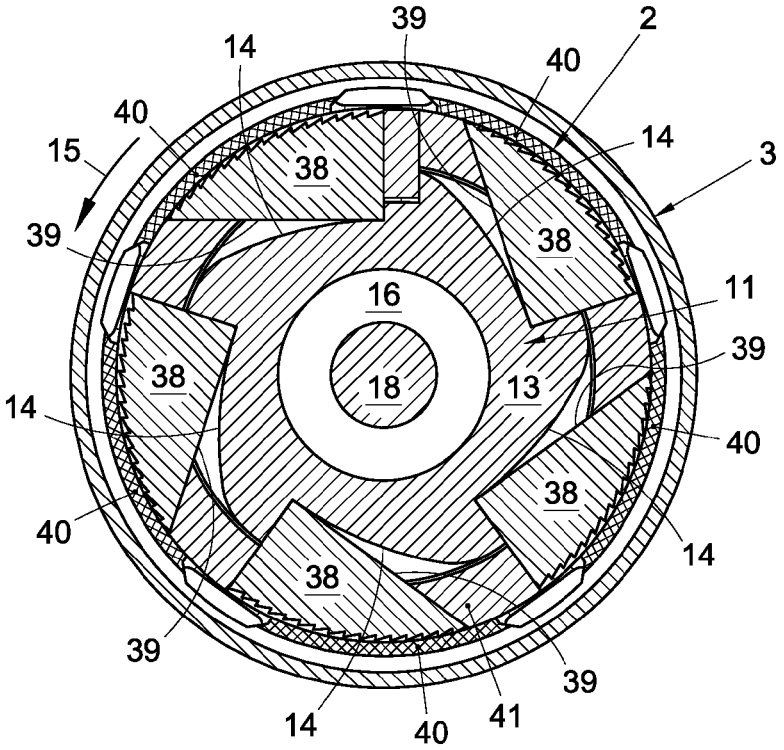
FIG. 4 is a cross-sectional view along the line IV-IV in FIG. 2.
Figure 5:
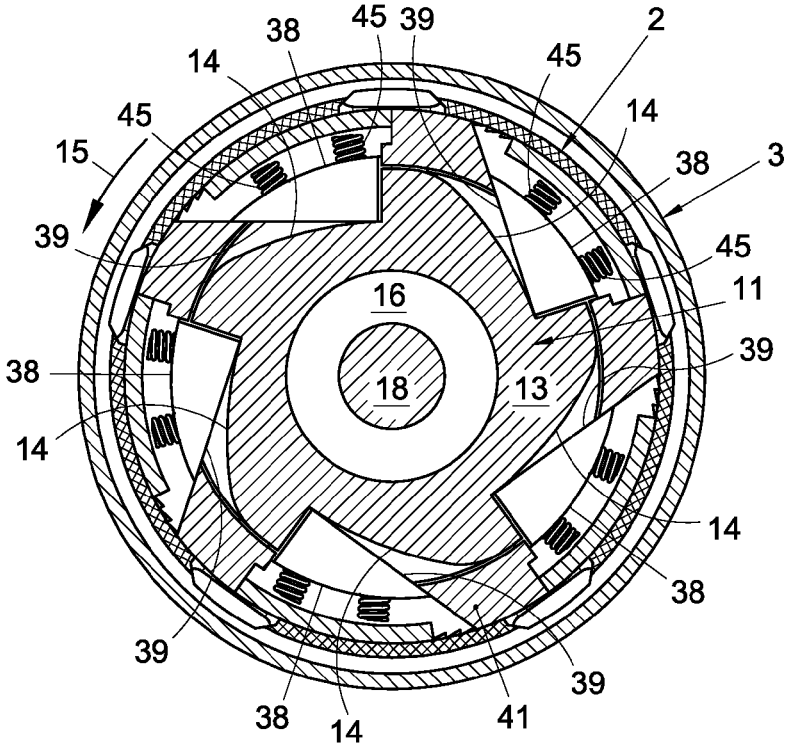
FIG. 5 is a cross-sectional view along the plane V-V in FIG. 2.

Section II-II in FIG. 2 corresponds to section II-II in FIG. 1. A mud motor (not shown) of the drilling and reaming unit 4 has a rotary part rotatable relative to a stationary motor part. The stationary motor part is coupled to a distal tool coupling 8 of the anchoring device 2, so that it is axially and rotationally stationary relative to the distal end portion 3 of a casing when in operation. A connecting shaft may also be provided between the tool coupling 8 and the drilling and reaming unit 4 and be equipped with instruments for measuring while drilling (MWD). The casing may be of steel, but for allowing electromagnetic measurements while drilling, at least a section of the casing surrounding the antenna(s) of such an instrument or instruments is preferably made of electromagnetically non-shielding material, such as composite material composed of fibers embedded in a polymer matrix. For allowing a magnetic field to be measured inside the casing while drilling, at least a section of the casing surrounding such an instrument or instruments is preferably made of a material having a relative magnetic permeability of approximately 1, such as most non-ferromagnetic substances, preferably of composite material as mentioned or aluminium. Such materials are also to a large extent transparent to acoustic measurement signals.

Some lateral movement of the mud motor in operation may be provided for to allow steering of the drilling direction. The rotary part of the mud motor is coupled to the underreamer 6 and the drilling head 5 is coupled thereto so that rotation of the rotary part of the mud motor can drive rotation of the underreamer 6 and the drilling head 5 about a central axis 9 thereof. The underreamer 6 and the drilling head 5 are located distally from the mud motor.

The anchoring device 2 is arranged for anchoring the mud motor and the drilling and reaming tool 4 in the casing string 1 so that reaction forces resulting from the torque exerted by the mud motor onto the drilling and reaming unit 4 as well as axial forces can be transferred to the casing string 3. To that end, the anchoring device 2 is releasably fixed relative to the casing string 3 against displacement relative to the casing section 3 in longitudinal direction of the casing section 3 and in rotational sense about the centre line 9 of the casing section 3. The fixation is sufficiently strong to withstand forces exerted during the material removal by the drilling head 5 and the underreamer 6. The axial load exerted during drilling may for instance be between plus or minus 200,000 N and the torque exerted during drilling is generally between 10,000 and 150,000 Nm.

The casing section 3 has an inner wall surface 10 clampingly engaged by the anchoring device 2. The anchoring device has a shaft 11 oriented in an axial direction (double arrow 12). The shaft 12 has a torque transfer section 13. The torque transfer section 13 has axially oriented outer cam surfaces 14 extending radially outwardly in a rotational sense (arrow 15). In the present example, the shaft 11 is hollow and bounds a mud channel 16 for channeling mud to the mud motor.

The anchoring device is provided with swap cups 47, 48 for sealing off the annular space between the anchoring device 2 and the inner wall surface 10 of the casing 3 and are arranged for resisting an operating pressure drop applied to mud to drive the mud motor. The swap cup 50 provides a sealing against excess pressure from the bottom of the borehole and shields the more proximal parts of the anchoring device from drill fluid, which typically contains debris produced during drilling. The swap cup 49 provides an additional sealing against excess pressure from the bottom of the borehole.

In the condition shown in the drawings, a valve-operating stem 18 of a running tool 17 extends through the mud channel 16 to ports 20 in a valve section 19 of the anchoring device 2. The ports 20 can be opened and closed by a valve body 22 in the form of a slide with slide ports 23 that are alignable with the ports 20 for allowing mud flow to bypass the swap cups 47-50 and the mud motor. The running tool 17 is shown in a position after lowering of the anchoring device 2 with the tools coupled thereto to the operating position projecting from the distal end of the casing as shown in FIG. 1. The slide ports 23 are aligned with the ports 20 for allowing mud to pass through as the anchoring device 2 and the tools coupled thereto are lowered through a column of mud in the casing. The valve section 19 may be provided with a support collar for centering the anchoring device 2 relative to the distal end portion 3 of the casing near its distal end coupling 8.

Figure 6:
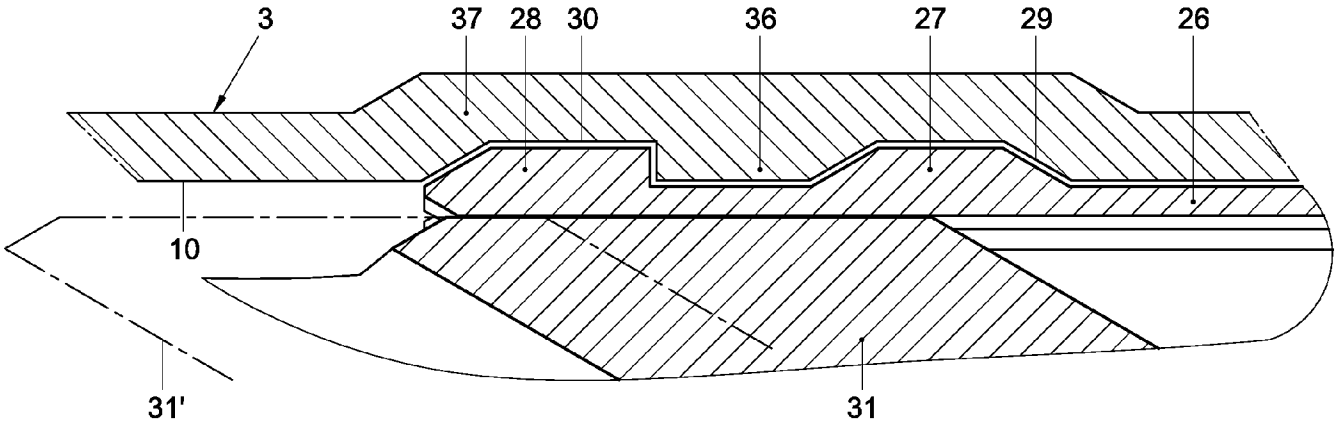
FIG. 6 is an enlarged view of portion VI in FIG. 3.
Figure 7:
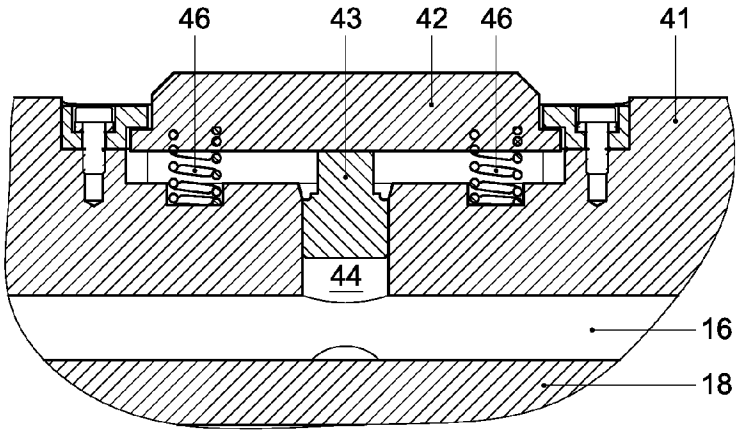
FIG. 7 is an enlarged view of portion VII in FIG. 3.
Figure 8:
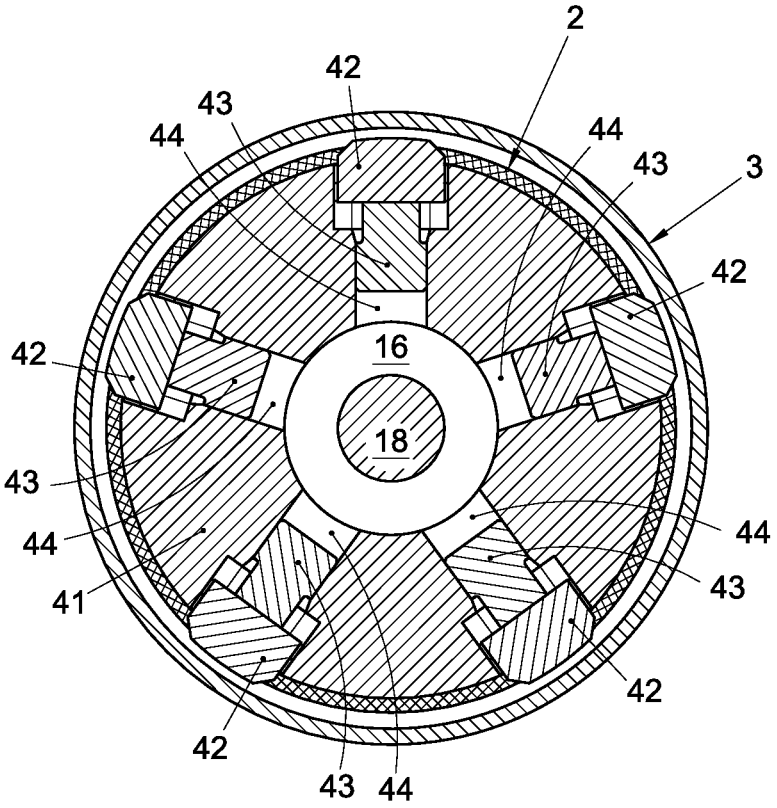
FIG. 8 is a cross-sectional view along the line VIII-VIII in FIG. 2.
Figure 9:
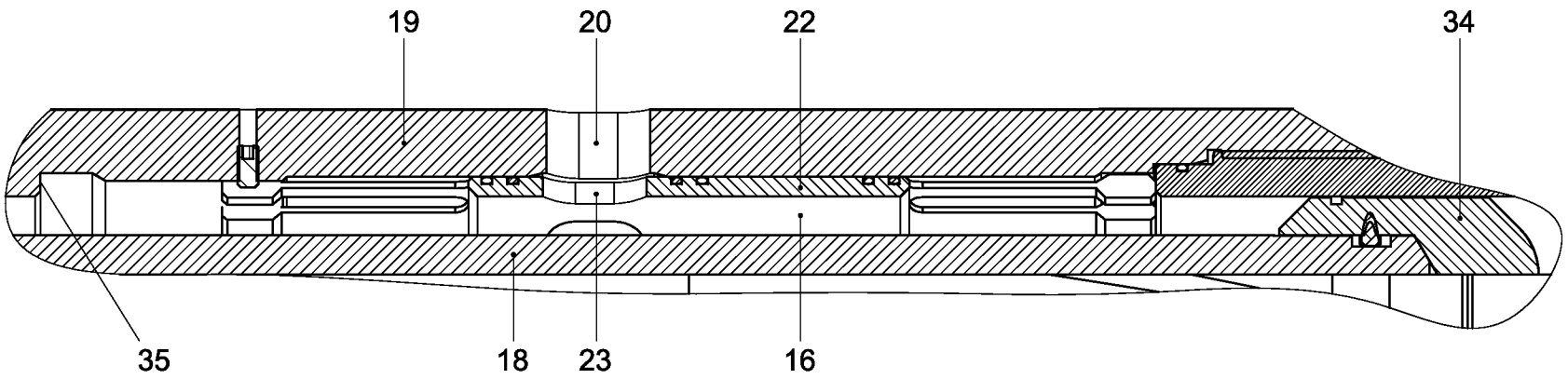
FIG. 9 is an enlarged view of portion IX in FIG. 3.

During lowering, the running tool 17 is coupled to a proximal end-coupling member 24 of the anchoring device 2 via a breakable latch 25. The anchoring device 2 has latches 26 in the form of flexible fingers with radially projecting notches 27, 28 biased radially outwardly for insertion into annular recesses 29, 30 of the inner wall surface 10 of a nippel 37 of the casing. As the anchoring device 2 and the tools connected thereto are suspended from the running tool 17 and move through the casing, the latch springs 26 are pressed inwardly and engage the annular slots 29, 30 when these are reached, so that it is ensured that the anchoring device 2 is stopped at a predetermined position. This radially inward movement of the latch springs 26 allowing passing the latch springs 26 along casing surface portions to the annular recesses 29, 30 is allowed since a locking portion 31 of the coupling member 24 is pulled away from between the latch springs 26 until a stopper 32 hits an abutment 33 and the locking portion has reached a lifted position 31' indicated with dash-and-dot lines in FIG. 6. An operating block 34 at the distal end of the valve-operating stem 18 is spaced far enough below the valve slide 22 to move with the proximal coupling member 24 while leaving the ports 20 open.

Once the notches 27, 28 reach the corresponding annular recesses 29, 30, the latch springs 26 snap outwardly so that the notches 27, 28 engage the corresponding annular recesses 29, 30 and stop the anchoring device 2 from descending further. Since the anchoring device 2 is then no longer suspended from the running tool 17 but supports the weight of the running tool 17, the running tool with the proximal coupling member 24 and the locking portion 31 descend to the descended position shown in the drawings in which the locking portion 31 is positioned between the latch springs 26, thereby locking the latch springs 26 in the radially expanded position engaging the annular recesses 29, 30.

The running tool 17 is then uncoupled from the proximal coupling member 24 by shearing a shear pin (not shown) and lifted out of the casing together with the valve-operating stem 18. This causes the operating block 34 to entrain the valve slide 22 to a lifted position against abutment 35 so that the ports 20 and 23 in the valve section 19 and the valve slide 22 are out of alignment and the bypass ports 20 are closed. Mud pressure applied to the casing is then channeled to the mud motor. The operating block 34 is then pulled through the valve sleeve 22 and entrained with the operating stem 18.

Because the latches 26 comprise a plurality of axially spaced radial protrusions 27, 28, the corresponding annular recesses 29, 30 can be relatively narrow and have rounded or beveled or chamfered first and last edges. This reduces the tendency of other parts, such as swap cups, of the anchoring device 2 and the tools attached thereto to hook up with edges of the annular recesses, thereby disturbing movement of the anchoring device 2 and the tools attached thereto through the casing.

For a smooth passage of such parts it is particularly advantageous if a lower one of the protrusions 27 has beveled or chamfered upper and lower edges and an upper one of the protrusions 28 has a beveled or chamfered upper edge and a square lower edge. The square lower edge can then provide reliable landing against a land 36 in the inner casing wall between the annular recesses 29, 30, which land 36 is recessed relative to the inner casing surface 10 above the upper recess 30 and below the lower recess 29. Thus, the edges of the annular recesses that meet the inner casing surface 10 above the upper recess 30 and below the lower recess 29 can be beveled or chamfered allowing a smooth passage of swap cups and other protruding parts, while hooking behind a square upper edge of the land 36 between the recesses is avoided because the land 36 is recessed relative to inner casing surface 10 above and below the annular recesses 29, 30. Reliable landing is nevertheless provided at the square upper edge of the land 36.

Premature hooking of the notches 27, 28 of the latch is avoided, because the lower notch is prevented from engaging the upper annular recess 30 by the upper notch 28 still lying against the inner wall 10 of the casing.

With the bypass ports 20 closed, mud pressure can be built up against the mud motor coupled to the distal coupling 8 to set the drill head 5 and the reamers 6 in rotation relative to the casing. Also the casing may be rotated inside the borehole in the same sense of rotation. The reaction torque would however set the mud motor and the anchoring device 2 coupled thereto in rotation within the casing instead of setting the drill head 5 and the reamers 6 in rotation in the desired sense of rotation 15 relative to the casing.

To anchor the anchoring device 2 against rotation relative to the casing opposite to the desired sense of rotation 15, the anchoring device 2 is equipped with a plurality of clamping bodies in the form of wedges 38 circumferentially distributed around the torque transfer section 13 with a limited movability relative to the torque transfer section 13 in rotational sense and in radial directions. The clamping bodies 38 each have an inner axially oriented clamping body surface 39 facing one of the cam surfaces 14 of the torque transfer section 13, an outer surface 40 defining a segment of a cylinder coaxial with the shaft 11 and converging with the inner clamping body surface 39 in the rotational sense 15.

The reactive torque exerted by the borehole on the drill head 5 and the reamers 6 is transferred via the mud motor and the distal tool coupling 8 to the shaft 11 which is caused to rotate relative to the casing in a sense opposite to the sense of rotation 15. This causes the cam surfaces 14 torque transfer section 13 to engage the clamping body surfaces 39, thereby clamping the clamping bodies 18 radially outwardly with outer surfaces 40 against the inner surface 10 of the casing. This causes the shaft 11 to be prevented from rotating further, so that the reactive torque is transferred to the casing and the drill head 5 and the reamers 6 are set in rotation in the desired sense of rotation 15.

The clamping bodies 38 can be released from the inner surface 10 of the casing in a reliable manner, by causing the torque transfer portion 13 of the shaft 11 to rotate in opposite sense of rotation in absence of a driving torque exerted by the mud motor. The rotation in the opposite sense of rotation in absence of the driving torque is caused by spring 21 that is tensioned when relative rotation of the shaft 11 and clamping bodies 38 causes the clamping bodies 38 to be urged radially outwardly. It is observed that the clamping and releasing of the anchoring device 2 is not dependent on axial displacement or positioning of the anchoring device 2 relative to the casing.

Instead of as wedges, the clamping bodies may also be provided in another form, for instance with a constant distance between the inner and outer surfaces. However, providing the clamping bodies in the form of wedges with the outer surfaces converging with the inner clamping body surfaces in the rotational sense, reliable release of the clamping action by rotating the torque transfer section in the rotational sense is achieved.

The clamping bodies 38 are suspended from a clamping body carrier 41 extending around the torque transfer section 13 and coupled to the clamping bodies 38 in the rotational sense 15. By keeping the clamping bodies 38 evenly distributed in circumferential sense, accurate centering of the shaft 11 relative to the inner surface 10 of the distal end portion 3 of the casing is achieved.

During lowering and lifting of the anchoring device 2, it is desired that the clamping bodies 38 are not pressed against the inner surface 10 of the casing string, since this would cause drag and wear. However an initial resistance from the casing is required to initiate the cam action causing the clamping bodies 38 to be pressed against the inner surface 10 of the distal end portion 3 of the casing. To create such an initial resistance, the anchoring device is equipped with drag shoes 42 coupled to and suspended in the clamping body carrier 41 and drag shoe biasing members 43 for biasing the drag shoes 42 radially outwardly against the inner surface 10 of the casing. The drag shoe biasing members 43 are provided in the form of pistons in bores 44 communicating with the mud channel 16. Thus, when mud pressure is built up for driving the mud motor, the drag shoes 42 are pushed radially outwardly against the inner surface 10 of the casing, causing frictional resistance against rotation of the anchoring device 2, and in particular the clamping body carrier 41, relative to the casing string. This resistance is sufficient to cause an initial camming action driving the clamping bodies 38 outwardly so that the clamping of the clamping bodies 38 against the inner surface of the casing is initiated. Springs 46 are provided that also bias the drag shoes outwardly, so that an initial resistance is also generated in absence of a mud pressure difference over the pistons 43.

To effectively avoid that the clamping bodies 38 scrape along the inner surface 10 of the casing string 3 during lowering and lifting, clamping body biasing members in the form of springs 45 are provided for biasing the clamping bodies 38 radially inwardly.

When the anchoring device is to be lifted again, a running tool 17 is coupled to the proximal coupling member 24. A valve-operating stem 18 carrying an operating block 34 pushes the slide valve in downward direction to open the bypass ports 20 again, so that mud can flow through the anchoring device during lifting through the mud column inside the casing.

The invention claimed is:

1. A casing system for lining a borehole in the ground comprising:

a casing sections; and a device for axially and rotationally anchoring in a casing in a borehole in the ground, the casing having an inner wall surface, the device comprising:

a shaft oriented in an axial direction, the shaft having a torque transfer section; the torque transfer section having axially oriented outer cam surfaces extending radially outwardly in a rotational sense, the shaft further comprising a drilling assembly including a drill bit and a reamer projecting from an end of the casing and wherein the lower end of the casing is located closely adjacent the reamer while the anchoring device is anchored to the casing; and a plurality of clamping bodies circumferentially distributed around the torque transfer section with a limited movability relative to the torque transfer section in rotational sense and in radial directions, the clamping bodies each having an inner, axially oriented clamping body surface facing one of the cam surfaces of the torque transfer section and an outer surface defining a segment of a cylinder coaxial with said shaft, wherein the clamping bodies are arranged for clamping against said inner wall surface and being released therefrom.

2. A casing system according to claim 1, wherein the clamping bodies are suspended from a clamping body carrier extending around the torque transfer section and coupled to the clamping bodies in at least rotational sense.

3. A casing system according to claim 2, further comprising at least one drag shoe coupled to the clamping body carrier and a drag shoe biasing member for biasing the at least one drag shoe radially outwardly against the casing wall.

4. A casing system according to claim 2, further comprising clamping body biasing members for biasing the clamping bodies radially inwardly.

5. A casing system according to claim 1, wherein the anchoring device further comprises at least one latch for radial insertion into an annular recess of an inner wall surface of the casing.

6. A casing system for lining a borehole in the ground comprising:

a casing section; and a device for anchoring in a casing in a borehole in the ground, the casing having an inner wall surface, the device comprising:

a shaft oriented in an axial direction, the shaft having a torque transfer section; the torque transfer section having axially oriented outer cam surfaces extending radially outwardly in a rotational sense, the shaft further comprising a drilling assembly including a drill bit and a reamer projecting from an end of the casing and wherein the lower end of the casing is located closely adjacent the reamer while the anchoring device is anchored to the casing; and a plurality of clamping bodies circumferentially distributed around the torque transfer section with a limited movability relative to the torque transfer section in rotational sense and in radial directions, the clamping bodies each having an inner, axially oriented clamping body surface facing one of the cam surfaces of the torque transfer section and an outer surface defining a segment of a cylinder coaxial with said shaft, wherein the clamping bodies are arranged for clamping against said inner wall surface and being released therefrom;

wherein the inner wall surface of the casing section comprises at least one annular recess and wherein the anchoring device further comprising at least one latch for insertion into said at least one annular recess of the inner wall surface of the casing.

7. A casing system according to claim 6, further comprising a coupling member for coupling to a running tool for lifting the device, the coupling member comprising a locking portion for locking the at least one latch in a radially expanded position engaging the annular recess and being displaceable in axial direction relative to the latch between a lifted position for allowing the at least one latch to be moved radially inwardly for passing along casing surface portions out of the annular recess and a descended position for locking the at least one latch in a radially outwardly projecting position for engaging the annular recess.

8. A casing system according to claim 6, wherein the at least one latch comprise two axially spaced radial protrusions.

9. A casing system according to claim 8, wherein a lower one of the protrusions has beveled or chamfered upper and lower edges and an upper one of the protrusions has a beveled or chamfered upper edge and a square lower edge.

10. A casing system according to claim 9, wherein the anchoring device further comprising a coupling member for coupling to a running tool for lifting the device, the coupling member comprising a locking portion for locking the at least one latch in a radially expanded position engaging the annular recess and being displaceable in axial direction relative to the latch between a lifted position for allowing the at least one latch to be moved radially inwardly for passing along casing surface portions out of the annular recess and a descended position for locking the at least one latch in a radially outwardly projecting position for engaging the annular recess, wherein a land in the inner casing wall between two of said annular recesses is recessed relative to the inner casing surface above an upper one of the recesses and below a lower one of the recesses, wherein the edges of the annular recesses that meet the inner casing surface above the upper recess and below the lower recess are beveled or chamfered, and wherein the land has a square upper edge.

11. A casing system according to claim 6, wherein the clamping bodies are suspended from a clamping body carrier extending around the torque transfer section and coupled to the clamping bodies in at least rotational sense.

12. A casing system according to claim 11, further comprising at least one drag shoe coupled to the clamping body carrier and a drag shoe biasing member for biasing the at least one drag shoe radially outwardly against the casing wall.

13. A casing system according to claim 11, further comprising clamping body biasing members for biasing the clamping bodies radially inwardly.

14. A casing system for lining a borehole in the ground comprising;

a casing section; and a device for anchoring in a casing in a borehole in the ground, the casing having an inner wall surface, the device comprising:

a shaft oriented in an axial direction, the shaft having a torque transfer section; the torque transfer section having axially oriented outer cam surfaces extending radially outwardly in a rotational sense, the shaft further comprising a drilling assembly including a drill bit and a reamer projecting from an end of the casing and wherein the lower end of the casing is located closely adjacent the reamer while the anchoring device is anchored to the casing; and a plurality of clamping bodies circumferentially distributed around the torque transfer section with a limited movability relative to the torque transfer section in rotational sense and in radial directions, the clamping bodies each having an inner, axially oriented clamping body surface facing one of the cam surfaces of the torque transfer section and an outer surface defining a segment of a cylinder coaxial with said shaft, wherein the clamping bodies are arranged for clamping against said inner wall surface and being released therefrom;

wherein at least a section of the casing surrounding an instrument or instruments for measuring a magnetic field while drilling is made of a material having a relative magnetic permeability of approximately 1.

* * * * *